US007322213B2

(12) United States Patent
Tamir et al.

(10) Patent No.: US 7,322,213 B2
(45) Date of Patent: Jan. 29, 2008

(54) MODIFIABLE JEWELRY

(76) Inventors: Alon Tamir, 8 Hagefen Street, Magshimim (IL); Ran Tamir, 2 Hakesbet Street, Kiryat Ono (IL); Nobuhiro Mizushima, I-6-4-11032 Sakuragawa Namwaku, Osaka 556-0022 (JP)

( * ) Notice: Subject to any disclaimer, the term of this patent is extended or adjusted under 35 U.S.C. 154(b) by 86 days.

(21) Appl. No.: 11/365,638

(22) Filed: Mar. 1, 2006

(65) Prior Publication Data

US 2007/0209391 A1 Sep. 13, 2007

(51) Int. Cl.
*A44C 15/00* (2006.01)

(52) U.S. Cl. ..... 63/23; 63/40; 63/1.16; 63/1.17

(58) Field of Classification Search ..... 63/3, 63/4, 23, 29.1, 33, 40, 1.16, 1.17; D11/79
See application file for complete search history.

(56) References Cited

U.S. PATENT DOCUMENTS 4,034,573 A 7/1977 Elkaim
4,970,878 A * 11/1990 Lee ..... 63/23
6,032,486 A 3/2000 Uchin
6,789,395 B2 9/2004 Molino et al.
6,880,364 B1 4/2005 Vidolin et al.

* cited by examiner

*Primary Examiner*—Jack W. Lavinder
(74) *Attorney, Agent, or Firm*—Stuart M. Goldstein

(57) ABSTRACT

A modifiable piece of jewelry has at least two ornamental display components. The first display component has opposite front and back sides which are finished as jeweled, gemstone, precious metal exterior or other finished ornamental display surface. The display surfaces are different and, in most cases, contrasting in ornamentation, color, jewelry setting, gemstone design, or precious metal exterior surface. A second ornamental display component also has opposite front and back sides with jeweled, gemstone, precious metal exterior or other finished ornamental display surfaces. The second ornamental component fits snugly within a cut-out of the first ornamental component. Internal surfaces of the first component and external surfaces of the second component form tight surfaces-to-surfaces connections, in order to maintain the components one within another. The different finished ornamental display surfaces of each component permits the single piece of jewelry to be worn in a variety of different display positions.

12 Claims, 6 Drawing Sheets

MODIFIABLE JEWELRY

BACKGROUND OF THE INVENTION

The present invention relates to jewelry, and particularly to pendants which are primarily designed to be hung form necklaces and bracelets, but which could also be used as earrings, pins and broaches.

Most pieces of jewelry are configured as integral, unitary components. While many are beautiful and often expensive, they are usually designed to be worn only in a single configuration and, as a result, their versatility is limited to that singular appearance. It is rare for a piece of jewelry, especially expensive jewelry, to be modifiable to allow that single piece to be worn in a plurality of display positions.

The limited, relevant prior art reflects jewelry which can be worn in several different configurations. Examples of these are found in U.S. Pat. No. 4,034,573, an ornament which consists of two changeable chain-like elements, U.S. Pat. No. 6,032,486, a reversible earring, U.S. Pat. No. 6,789,395, a pendant necklace which is convertible to three different geometric configurations, and U.S. Pat. No. 6,880,364, a bracelet with exchangeable decorative loop members. However, such prior jewelry pieces and those similar in the prior art fail to provide for the modification and resulting versatility of the present invention, which presents a myriad of options to the creator and especially to the wearer of expensive jewelry.

SUMMARY OF THE INVENTION

It is thus the object of the present invention to overcome the limitations and disadvantages of existing modifiable jewelry.

It is the object of the present invention to provide jewelry whose appearance is easily, reliably, and quickly modified to a plurality of display positions.

It is another object of the present invention to provide jewelry which is modifiable to allow the wearer at least eight and, depending on the configuration of the jewelry, additional display positions.

It is a further object of the present invention to provide jewelry which can easily, reliably, and quickly be modified to present a plurality of different esthetic appearances in a single piece of jewelry.

It is still another object of the present invention to provide jewelry which permits the jewelry's designer and creator to offer the wearer an infinite number of options, using a variety of different jeweled, gemstone, precious metal, or other ornamental display surfaces.

These and other objects are accomplished by the present invention, a modifiable jewelry piece which has at least two ornamental display components. The first display component has opposite front and back sides which are finished as jeweled, gemstone, precious metal exterior or other finished ornamental display surface. The display surfaces are different and, in most cases, contrasting in ornamentation, color, jewelry setting, gemstone design, or precious metal exterior surface. A second ornamental display component also has opposite front and back sides with jeweled, gemstone, precious metal exterior or other finished ornamental display surfaces. The second ornamental component fits snugly within a cut-out of the first ornamental component. Internal surfaces of the first component and external surfaces of the second component form tight surfaces-to-surfaces connections, in order to maintain the components one within another. The different finished ornamental display surfaces of each component permits the single piece of jewelry to be worn in a variety of different display positions.

The novel features which are considered as characteristic of the invention are set forth in particular in the appended claims. However, both as to their design, construction, and use, together with additional features and advantages thereof, they are best understood upon review of the following detailed description with reference to the accompanying drawings.

DETAILED DESCRIPTION OF THE INVENTION

Figure 1:
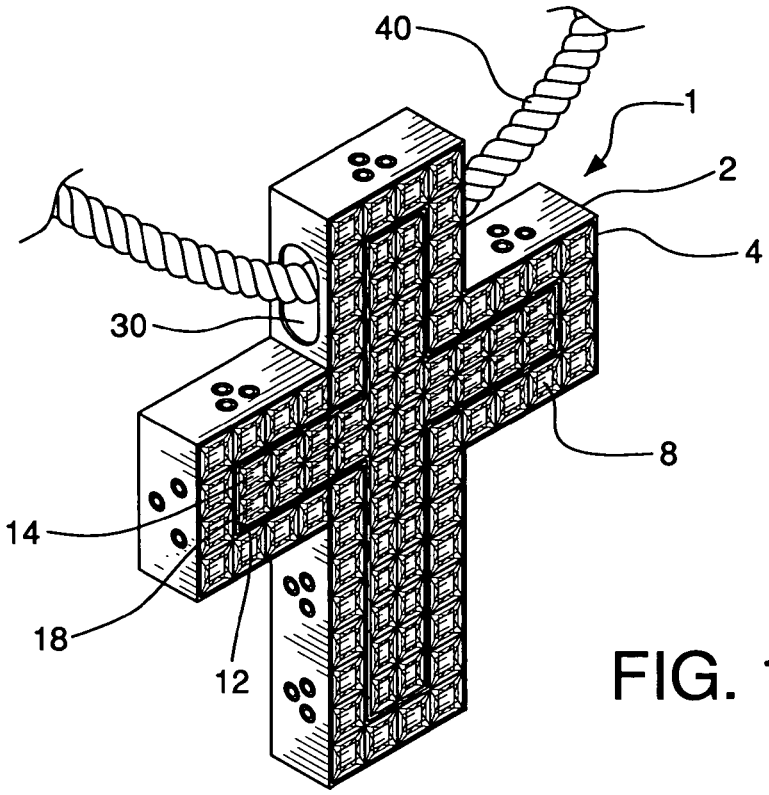
FIG. 1 is an isometric view of the present invention showing one of its display positions.

Jewelry piece 1 comprises first ornamental display component 2 and second ornamental display component 12. First component 2 has opposite front and back sides 4 and 6. Side 4, as shown in FIGS. 1, 3, 4 and 8, can comprise jeweled, gemstone, precious metal exterior or other finished ornamental display surface 8. Display surface 8, by way of example in the drawings, consists of small, aligned gemstones. Side 6, as shown in FIGS. 2, 5, 6, and 10, can comprise jeweled, precious metal exterior or other finished ornamental display surface 10. Display surface 10, by way of example in the drawings, is depicted as a yellow gold exterior surface.

Display surfaces 8 and 10 are different and, in most cases, contrasting in ornamentation, color, jewelry setting, gemstones, precious metal exterior, etc. For instance, one display surface can comprise clear diamonds and the opposite display surface can comprise different sized or colored gemstones. In another example, one display surface can comprise colored gemstones or a gemstone design and the second display surface can be white gold or yellow gold. Although depicted in one manner in the drawings, the invention is not to be considered restricted to the type of finished display surface which overlays sides 4 and 6 of component 2. Any desired gemstone, precious metal, or other ornamental design or jeweled configuration can be used as the finished display surfaces on sides 4 and 6 of component 2. While display surfaces 8 and 10 can be the same, for optimal versatility of this invention, the surfaces should be different and, most advantageously, contrasting.

Similarly second ornamental display component 12 has opposite front and back sides 14 and 16. Side 14, as shown in FIGS. 1, 3, 5, and 7, comprises jeweled, gemstones, precious metal exterior or other finished ornamental display surface 18. Display surface 18, by way of example in the drawings, shows small aligned gemstones which can be the same as those on display surface 8, or different, either in color, type, alignment, size, etc. Side 16, as shown in FIGS. 2, 4, 6, and 9, comprise jeweled, gemstone, precious metal exterior or other finished ornamental display surface 20. Display surface 20, by way of example in the drawings, is depicted as a yellow gold exterior surface. Again, the finish of display surface 20 should not be considered so restricted.

As with display surfaces 8 and 10 of component 2, display surfaces 18 and 20 of component 12 are different and, in most cases, contrasting in ornamentation, color, jewelry setting, gemstones, precious metal exterior, etc. It is contemplated that the infinite ornamental possibilities, as described previously with regard to finished display surfaces 8 and 10 of component 2, are available for finished display surfaces 18 and 20 of component 12. And, once again, the invention is not to be considered restricted to the type of finished display surface which overlays sides 14 and 16 of component 12, also as discussed previously.

Figure 8:
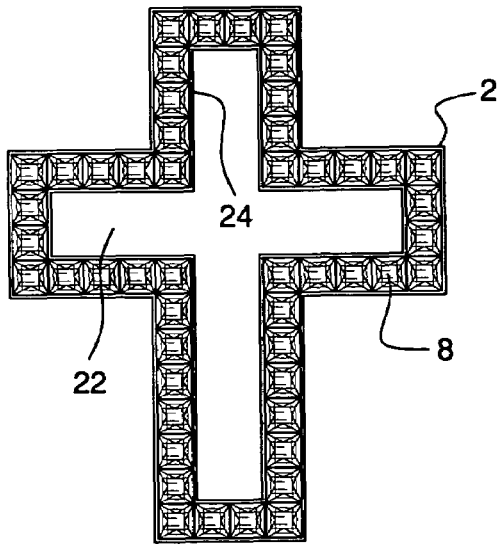
FIG. 8 is a front view of the present invention showing another display position.
Figure 9:
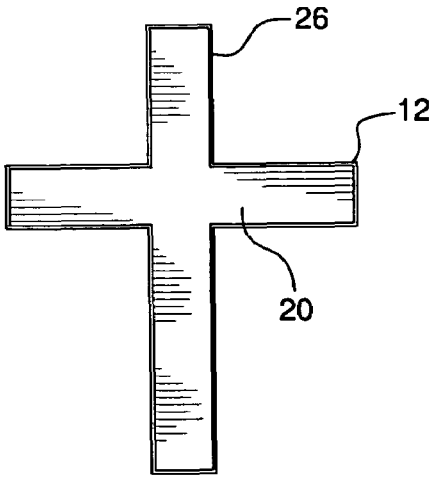
FIG. 9 is a front view of the present invention showing another display position.
Figure 10:
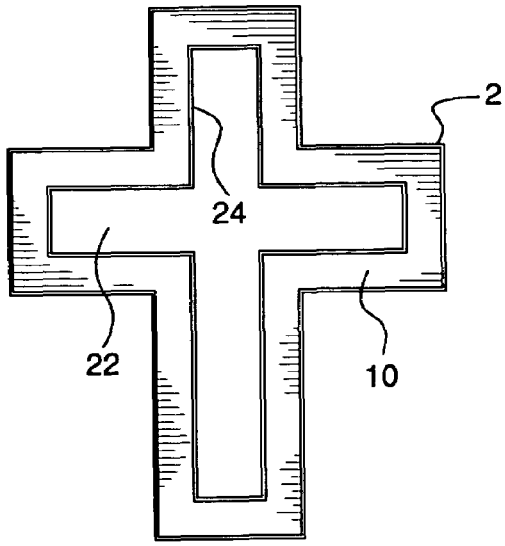
FIG. 10 is a front view of the present invention showing another display position.
Figure 11:
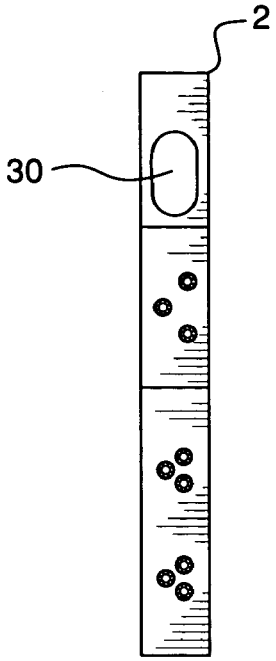
FIG. 11 is a side view of the present invention as it is shown in FIG. 1.
Figure 12:
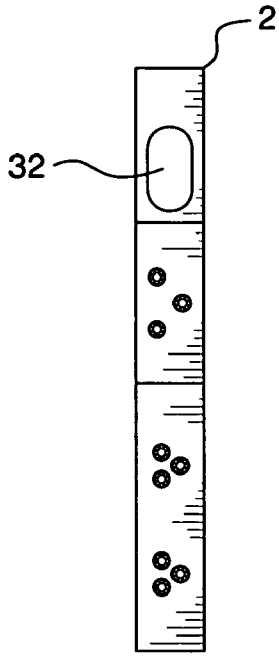
FIG. 12 is an opposite side view to that which is shown in FIG. 11.
Figure 13:
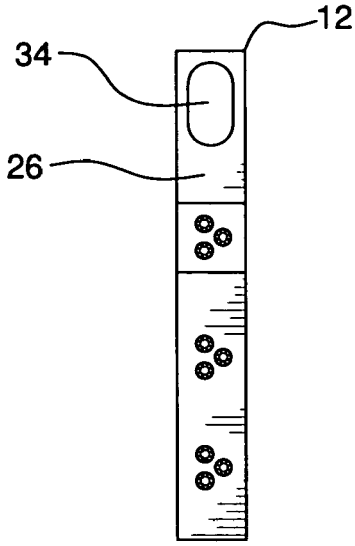
FIG. 13 is a side view of the present invention as it is shown in FIG. 9.
Figure 14:
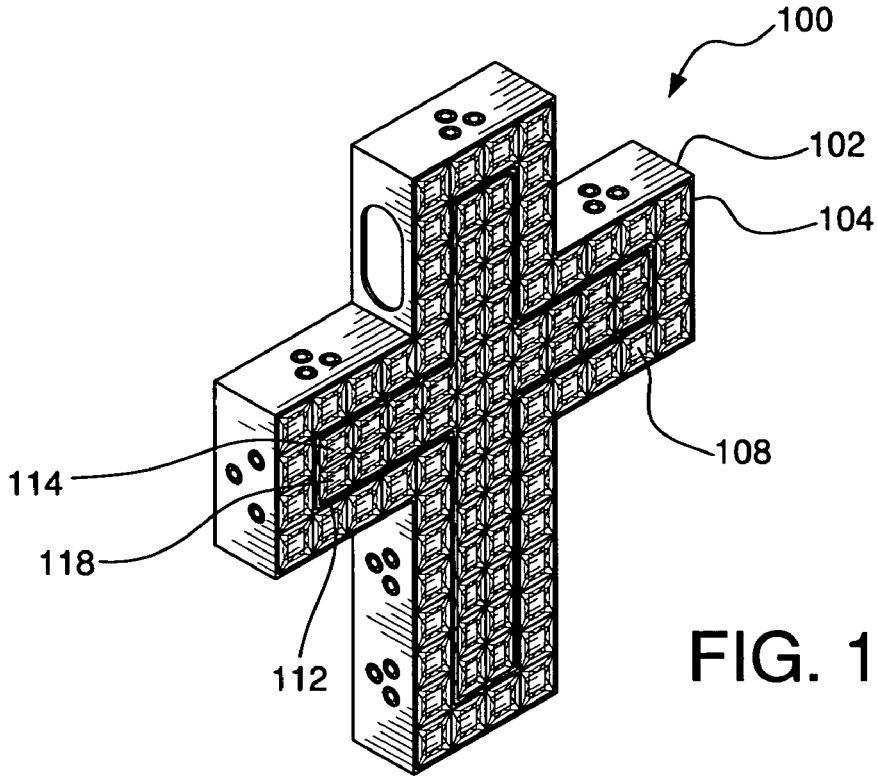
FIG. 14 is an isometric view of a second configuration of the present invention showing one of its display positions.
Figure 15:
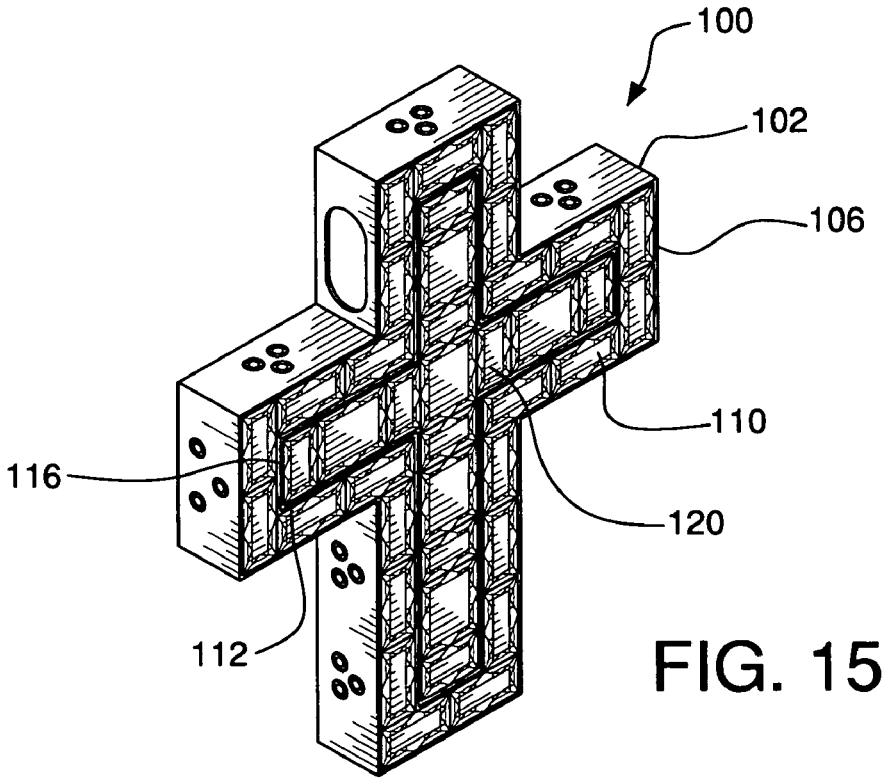
FIG. 15 is an isometric view of the configuration shown in FIG. 14.
Figure 16:
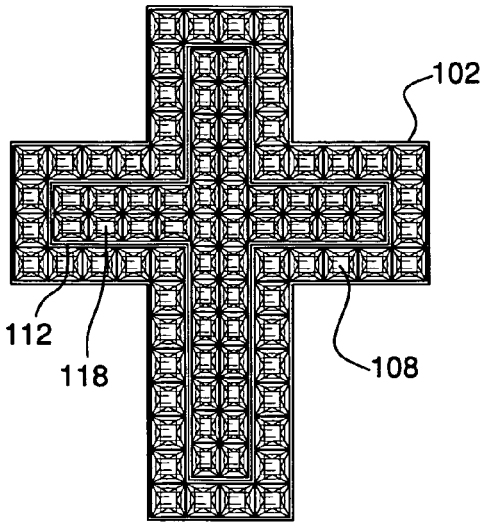
FIG. 16 is a front view of the display position shown in FIG. 14.
Figure 17:
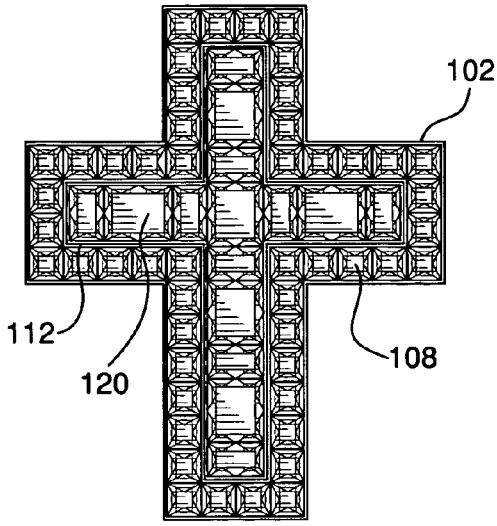
FIG. 17 is a front view of another display position of the second configuration of the present invention.
Figure 18:
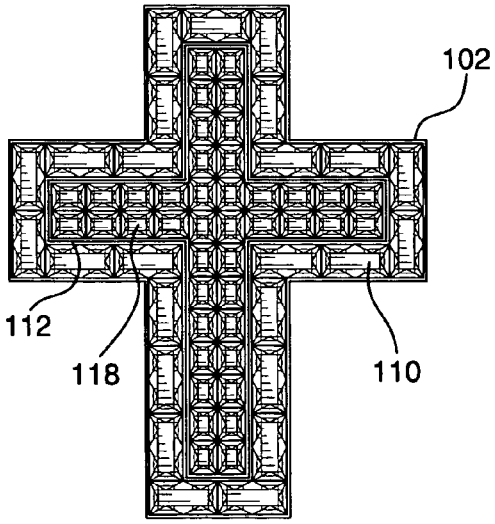
FIG. 18 is a front view of another display position of the second configuration of the present invention.
Figure 19:
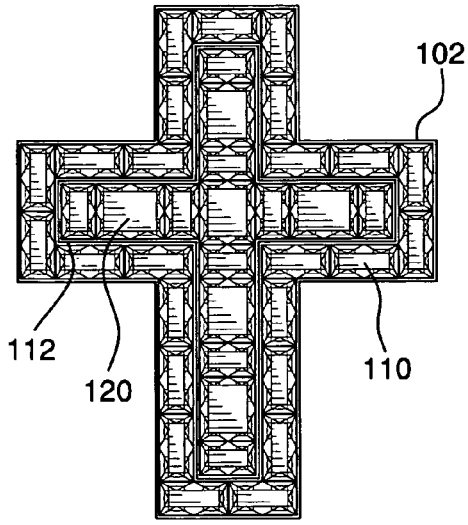
FIG. 19 is a front view of another display position of the second configuration of the present invention.

As seen in FIGS. 8 and 9, component 2 comprises through cut-out opening 22, bordered by internal surfaces 24 which circumscribe opening 22 of the component. Component 12, circumscribed by external surfaces 26, is sized to fit snugly within cut-out opening 22. Internal surfaces 24 of component 2 and external surfaces 26 of component 12 form tight surfaces-to-surfaces connection, in order to maintain component 12 snugly within component 2. However, the connection is not so tight that the wearer cannot separate and remove the components, one from the other.

Component 2 further comprises chain openings 30 and 32 and component 12 comprises chain opening 34, through which a chain or similar wearable necklace or bracelet component 40 can be fed, thus permitting components 2 and 12 to hang from a necklace or bracelet. When component 12 is located within cut-out opening 22 of component 2, chain opening 34 is congruent with chain openings 30 and 32 and chain component 40 extends through openings 30, 32, and 34.

Figure 2:
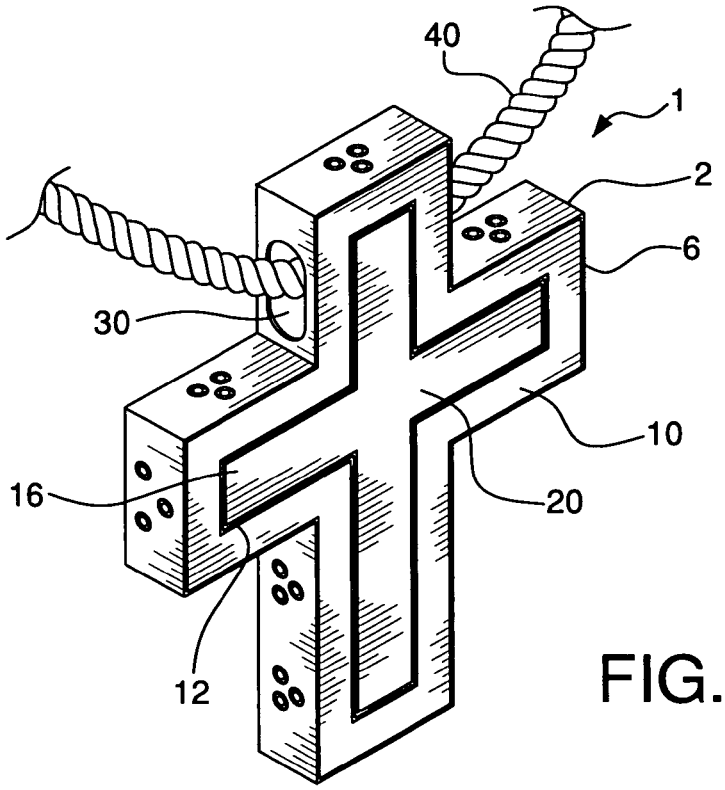
FIG. 2 is an isometric view of the present invention rotated 180° from that which is shown in FIG. 1, showing a second display position.
Figure 3:
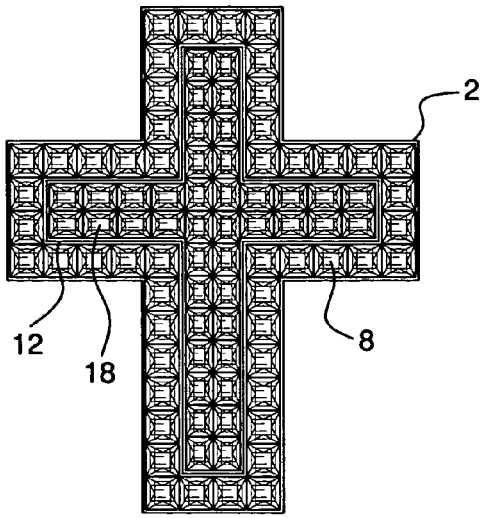
FIG. 3 is a front view of the present invention and the display position shown in FIG. 1.

Thus, jewelry piece 1, as described herein, can be modified for wear in eight different display positions. FIG. 1 shows jewelry piece 1 with component 12 fitted within component 2 and hung from chain 40, with finished surfaces 8 and 18 facing outward for display. FIG. 2 shows jewelry piece 1 with component 12 fitted within component 2 and the jewelry piece rotated 180° from the display position shown in FIG. 1 and hung on chain 40, with finished surfaces 10 and 20 facing outward for display.

Figure 4:
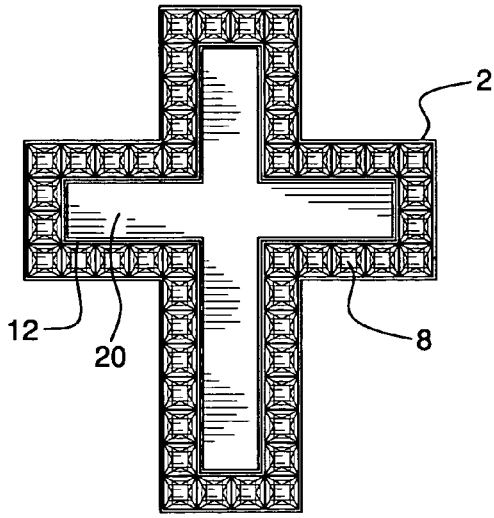
FIG. 4 is a front view of the present invention showing another display position.
Figure 5:
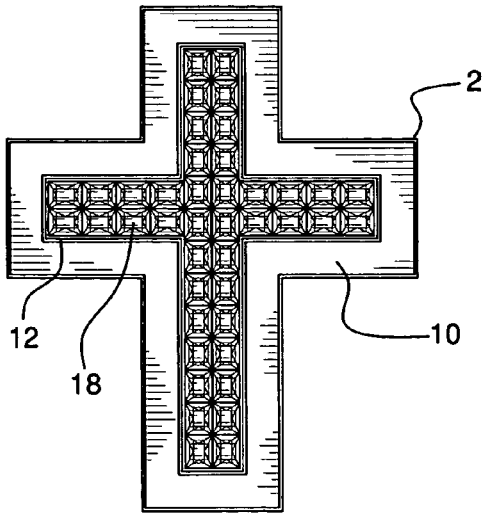
FIG. 5 is a front view of the present invention showing another display position.
Figure 6:
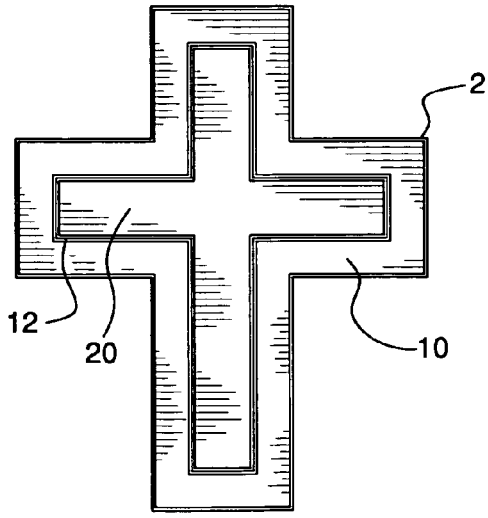
FIG. 6 is a front view of the present invention showing the display position shown in FIG. 2.
Figure 7:
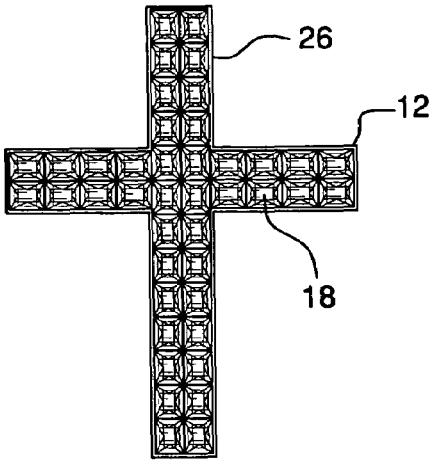
FIG. 7 is a front view of the present invention showing another display position.

By simply removing component 12 from component 2, while it is in cut-out 22, and then rotating component 12 and reinserting it snugly into cut-out 22, the user creates two new display positions as shown in FIGS. 4 and 5. That is, FIG. 4 shows the jewelry piece of the invention with component 12 fitted within component 2, with finished surfaces 8 and 20 facing outward for display. FIG. 5 shows the jewelry piece of the invention with component 12 fitted within component 2 and the jewelry piece rotated 180° from the display position shown in FIG. 4, with finished surfaces 10 and 18 facing outward for display.

When component 12 is removed and separated from component 2, each component can be worn separately and, since each component has two finished display surfaces, four additional display positions, shown in FIGS. 7-10, are available to the wearer.

FIGS. 14-19 exemplify how the jewelry of the present invention can be configured if the jewelry piece uses gemstones on both sides of both ornamental components. The figures show jewelry piece 100 with the cross design described above and with front sides 104 and 114 of ornamental display components 102 and 112 having display surfaces 108 and 118. These display surfaces comprise small aligned gemstones, similarly to that which was described with reference to jewelry piece 1. However, the back sides 106 and 118 of display components 102 and 112 have display surfaces 110 and 120 comprising larger aligned gemstones, which provide a marked contrast to the smaller gemstones of display surfaces 108 and 118. Whether the gemstones which are used are of different or the same colors or type, distinct designs are created by the different interchangeable display positions shown in FIGS. 14-19.

While jewelry pieces 1 and 100 shown in FIGS. 1-19 take the shape of a cross, the shape or configuration of the jewelry which employs this invention is not to be restricted to a cross-shaped piece. It is contemplated that the unique features of the herein described invention can and will be employed with any and all shaped pieces of jewelry which can be fabricated by forming separate interchangeable and insertable ornamental components. It is further contemplated thank in order to further increase the modifiability, options, and versatility of the single jewelry piece, more than two ornamental components with finished front and back surfaces may be employed to form the single jewelry piece. For instance, more than one cut-out opening can be provided on the larger ornamental component to accept insertable ornamental components. Also, more than one insertable ornamental component can be positioned in the cut-out or cut-outs.

Thus, presented herein is unique jewelry which begins as a single piece, but, when fabricated with two or more ornamental components, has the versatility to be displayed in a plurality of separate display positions at the preference of the user.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. Modifiable jewelry comprising:

a first ornamental component having two opposing sides, said component comprising a first finished display surface on one side of the component and a second finished display surface on the second side of the component, said component having a cut-out opening and means by which the component is hung from a chain;

a second ornamental component having two opposing sides and means by which the second component is hung from a chain, said second component comprising a first finished display surface on one side of the component and a second finished display surface on the second side of the component, said second ornamental component being insertable into the cut-out opening; and means to maintain the second ornamental component fixedly within the cut-out opening such that the means for hanging of the first ornamental component and the means for hanging of the second ornamental component means are congruent when the second ornamental component is fixedly positioned within the cut-out opening of the first ornamental component, whereby when the second ornamental component is inserted within the cut-out opening the jewelry can be displayed in at least four different display positions and when the second ornamental component is removed from the first ornamental component, the jewelry can be displayed in at least four additional different display positions.

2. The jewelry as in claim 1 wherein said means to maintain comprises internal surfaces of the first ornamental component fitted in snug surfaces-to-surfaces contact with external surfaces of the second ornamental component.

3. The jewelry as in claim 1 wherein one of the display positions comprises the second ornamental component fixedly positioned within the cut-out opening of the first ornamental component such that the first finished display surface of the first ornamental component and the first finished display surface of the second ornamental component face outwardly.

4. The jewelry as in claim 1 wherein one of the display positions comprises the second ornamental component fixedly positioned within the cut-out opening of the first ornamental component such that the first finished display surface of the first ornamental component and the second finished display surface of the second ornamental component face outwardly.

5. The jewelry as in claim 1 wherein one of the display positions comprises the second ornamental component fixedly positioned within the cut-out opening of the first ornamental component such that the second finished display surface of the first ornamental component and the first finished display surface of the second ornamental component face outwardly.

6. The jewelry as in claim 1 wherein one of the display positions comprises the second ornamental component fixedly positioned within the cut-out opening of the first ornamental component such that the second finished display surface of the first ornamental component and the second finished display surface of the second ornamental component face outwardly.

7. The jewelry as in claim 1 wherein one of the display positions comprises the first ornamental component being removed and separated from the second ornamental component and having its first finished display surface facing outwardly.

8. The jewelry as in claim 1 wherein one of the display positions comprises the first ornamental component being removed and separated from the second ornamental component and having its second finished display surface facing outwardly.

9. The jewelry as in claim 1 wherein one of the display positions comprises the second ornamental component being removed and separated from the first ornamental component and having its first finished display surface facing outwardly.

10. The jewelry as in claim 1 wherein one of the display positions comprises the second ornamental component being removed and separated from the first ornamental component and having its second finished display surface facing outwardly.

11. Modifiable jewelry comprising:

a first ornamental component having two opposing sides, said component comprising a first finished display surface on one side of the component and a second finished display surface on the second side of the component, said component having a cut-out opening and means by which the component is hung from a chain;

a second ornamental component having two opposing sides and means by which the second component is hung from a chain, said second component comprising a first finished display surface on one side of the component and a second finished display surface on the second side of the component, said second ornamental component being insertable into the cut-out opening; and means to maintain the second ornamental component fixedly within the cut-out opening such that the means for hanging of the first ornamental component and the means for hanging of the second ornamental component means are congruent when the second ornamental component is fixedly positioned within the cut-out opening of the first ornamental component, whereby when the second ornamental component is inserted within the cut-out opening the jewelry can be displayed in a plurality of different display positions and when the second ornamental component is removed from the first ornamental component, the jewelry can be displayed in a plurality of additional different display positions.

12. The jewelry as in claim 11 wherein said means to maintain comprises internal surfaces of the first ornamental component fitted in snug surfaces-to-surfaces contact with external surfaces of the second ornamental component.

* * * * *